US008813386B2

(12) United States Patent
Pucci

(10) Patent No.: US 8,813,386 B2
(45) Date of Patent: Aug. 26, 2014

(54) SHOE

(76) Inventor: Klary Pucci, Studio City, CA (US)

( * ) Notice: Subject to any disclaimer, the term of this patent is extended or adjusted under 35 U.S.C. 154(b) by 637 days.

(21) Appl. No.: 12/768,961

(22) Filed: Apr. 28, 2010

(65) Prior Publication Data

US 2010/0275462 A1 Nov. 4, 2010

Related U.S. Application Data

(60) Provisional application No. 61/175,241, filed on May 4, 2009.

(51) Int. Cl.
*A43B 3/12* (2006.01)
*A43B 3/24* (2006.01)

(52) U.S. Cl.
CPC ..... *A43B 3/126* (2013.01); *A43B 3/248* (2013.01)
USPC ..... 36/11.5; 36/100

(58) Field of Classification Search
CPC ..... A43B 3/126; A43B 3/248; A43B 3/10; A43B 3/12; A43B 3/122; A43B 3/128
USPC ..... 36/11.5, 7.7, 7.5, 7.6, 135
See application file for complete search history.

(56) References Cited

U.S. PATENT DOCUMENTS

| | | | | | |
|---|---|---|---|---|---|
| 1,236,427 | A | | 8/1917 | Halley | |
| 1,888,862 | A | * | 11/1932 | Mathews | 36/12 |
| 2,090,675 | A | * | 8/1937 | Hadaway | 12/142 S |
| 2,112,884 | A | * | 4/1938 | Gillette et al. | 36/11.5 |
| 2,526,940 | A | * | 10/1950 | Fello | 36/11.5 |
| D171,717 | S | * | 3/1954 | Langford | D2/906 |
| D176,886 | S | | 2/1956 | Russell | |
| 2,801,478 | A | * | 8/1957 | Gilbert | 36/7.5 |
| D199,300 | S | | 10/1964 | Martin | |
| 3,775,873 | A | * | 12/1973 | Small | 36/11.5 |
| 4,372,057 | A | | 2/1983 | Nielsen | |
| 5,038,499 | A | | 8/1991 | Martinez, Jr. | |
| D351,719 | S | | 10/1994 | Piotrowicz | |
| D388,242 | S | | 12/1997 | Cole | |
| 5,992,058 | A | | 11/1999 | Jneid | |
| 6,128,834 | A | | 10/2000 | Vecchiola et al. | |
| 6,651,359 | B1 | | 11/2003 | Bricker | |
| 6,792,696 | B2 | | 9/2004 | Berg et al. | |
| 7,028,420 | B2 | | 4/2006 | Tonkel | |
| 7,162,814 | B2 | | 1/2007 | Berg et al. | |
| 7,174,657 | B2 | | 2/2007 | Berg et al. | |
| D556,990 | S | | 12/2007 | Cabados | |
| D587,886 | S | | 3/2009 | Neate | |
| D587,887 | S | | 3/2009 | Neate | |
| D587,888 | S | | 3/2009 | Neate | |
| 2005/0229428 | A1 | * | 10/2005 | Holcomb | 36/7.1 R |
| 2007/0204483 | A1 | * | 9/2007 | Kirsch et al. | 36/11.5 |
| 2007/0220777 | A1 | * | 9/2007 | Richardson | 36/11.5 |
| 2008/0098616 | A1 | * | 5/2008 | Leedy | 36/11.5 |
| 2008/0127527 | A1 | | 6/2008 | Chen | |

FOREIGN PATENT DOCUMENTS

| | | | | | |
|---|---|---|---|---|---|
| GB | 2147792 | A | * | 5/1985 | A43B 3/12 |

* cited by examiner

*Primary Examiner* — Ted Kavanaugh
(74) *Attorney, Agent, or Firm* — DLA Piper LLP US

(57) ABSTRACT

A shoe, comprising a sole member having an upper surface configured to receive a user's foot and a lower surface configured to contact a support surface; the shoe being flexible so that that shoe can be folded up and stored in a container.

8 Claims, 18 Drawing Sheets

SHOE

CROSS-REFERENCE TO RELATED APPLICATIONS

This application is based on and derives the benefit of the filing date of U.S. Provisional Patent Application No. 61/175,241, filed May 4, 2009. The entire content of this application is herein incorporated by reference in its entirety.

DETAILED DESCRIPTION

A shoe is disclosed, the shoe having a shoe sole with holes therethrough for receiving a removable strap, with the strap having ends that may be joined so as to form a shoe upper. The strap can be tied in numerous ways using the holes. Embodiments illustrating 4 sets of holes (FIGS. 1-7), 5 sets of holes (FIGS. 8-14) and 3 sets of holes (FIGS. 15-21) are illustrated. However, other numbers of holes or sets of holes, or other configurations of holes can be used.

Figure 1:
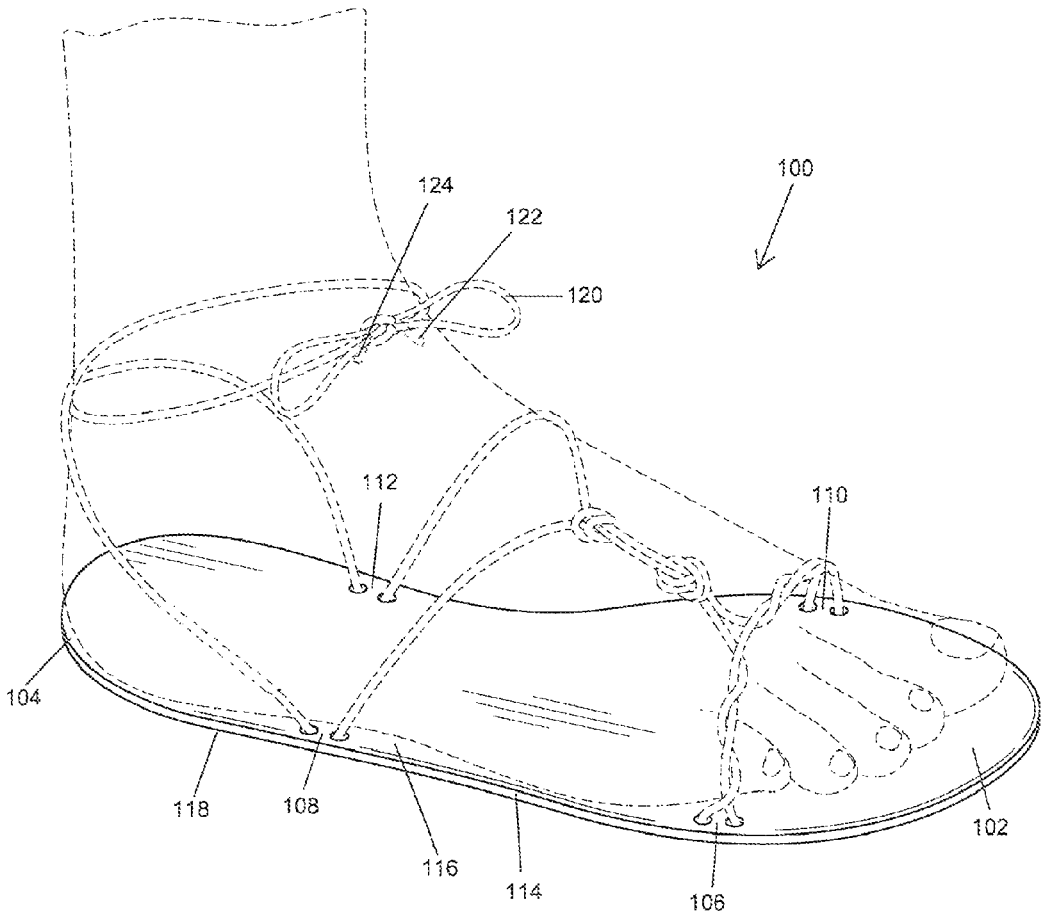
FIGS. 1-7 illustrate various views of a shoe with four sets of holes, according to one embodiment.

Referring to FIG. 1, a perspective view of a shoe with 4 sets of holes 100 is shown, according to one embodiment. The shoe can include a sole member 114 with a top surface 116 and a bottom surface 118. In use, a user's foot can be placed on the top surface 116 and the bottom surface 118 can contact a support surface, such as the floor or the ground. In one embodiment, the bottom surface can have an attachment (e.g., a rubber attachment or other attachment material which makes the shoe more comfortable) where the heel and/or the ball of the foot contact the bottom surface. In some embodiments, the top surface 116 can be formed of a different material than the remainder of the sole member 114. Materials which can be used for the sole member 114 can include any type of plastic, rubber, leather, synthetic leather, fabric, thermoplastic urethane, or ethylene-vinyl acetate (EVA) or any combination thereof. The material used for the sole member 114 can be flexible or non-flexible. Those of ordinary skill in the art will see that any type of material that can be used for shoes can be used for the sole member 114.

Figure 15:
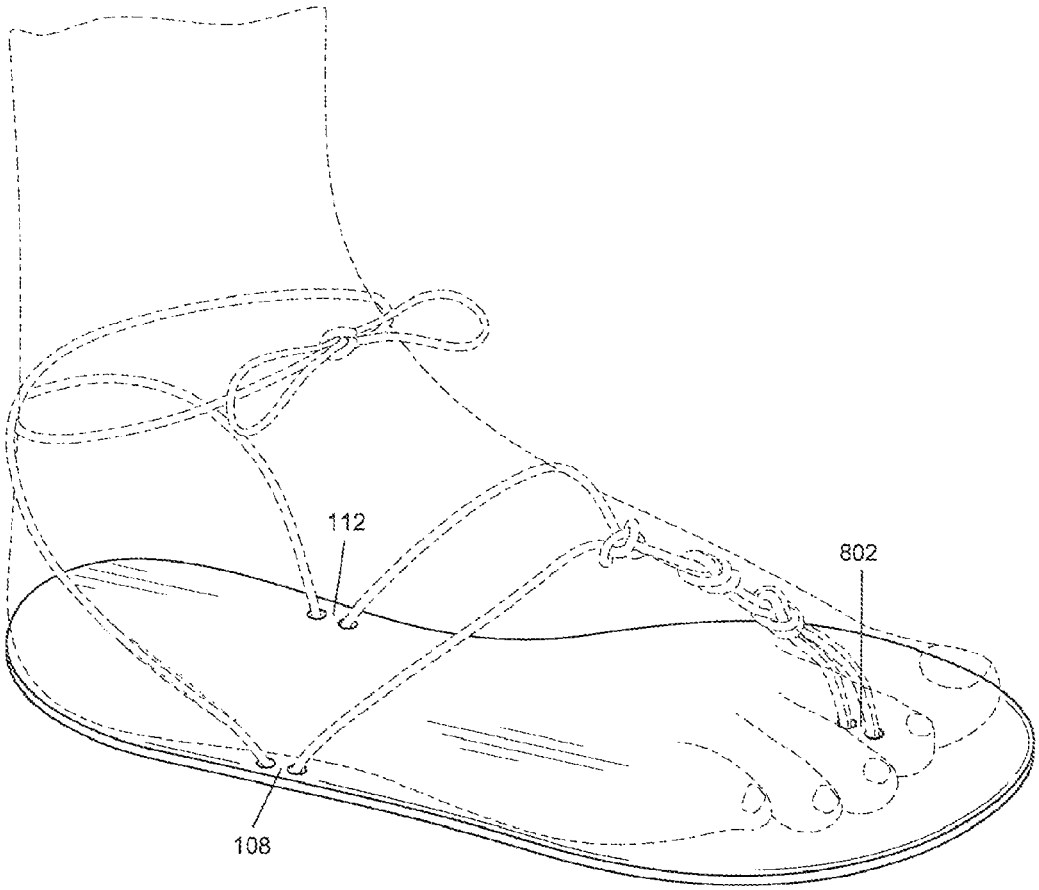
FIGS. 15-21 illustrate various views of a shoe with three sets of holes, according to one embodiment.
Figure 16:
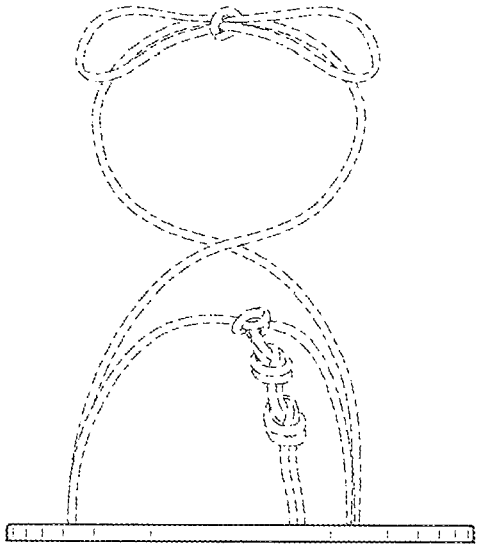
Figure 17:
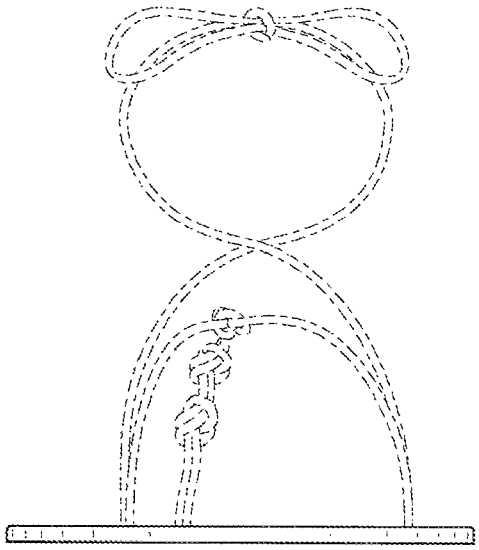
Figure 18:
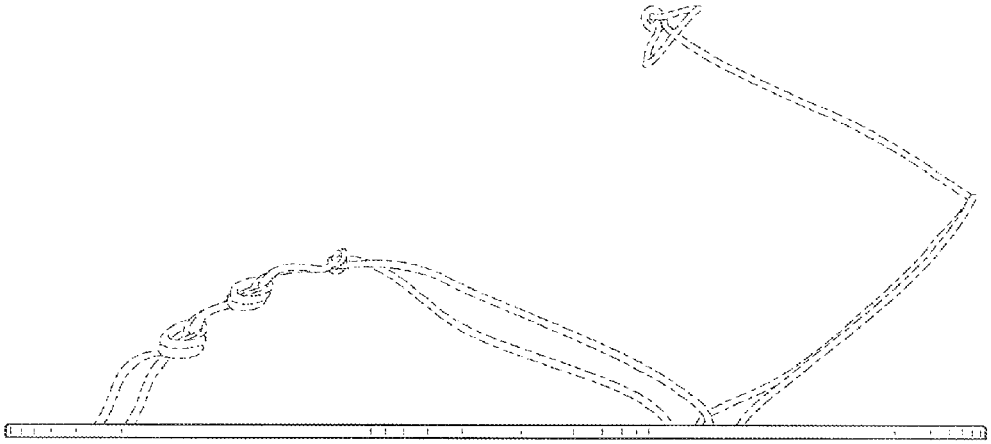
Figure 19:
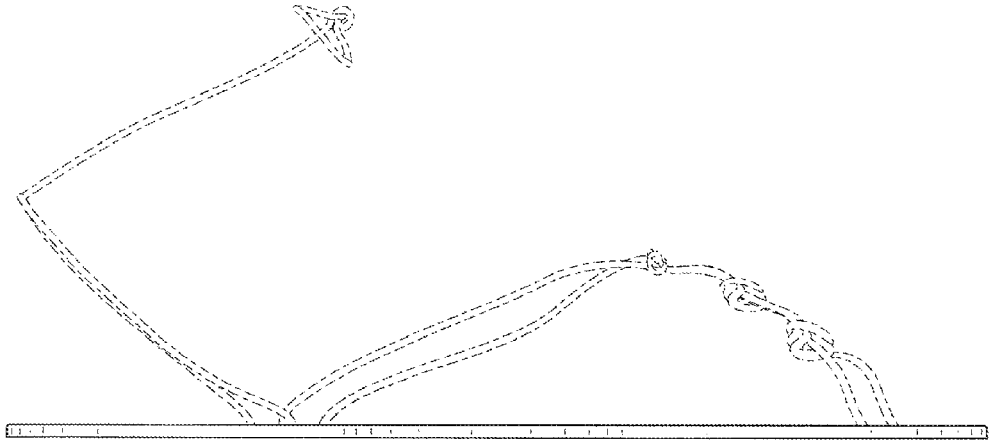
Figure 20:
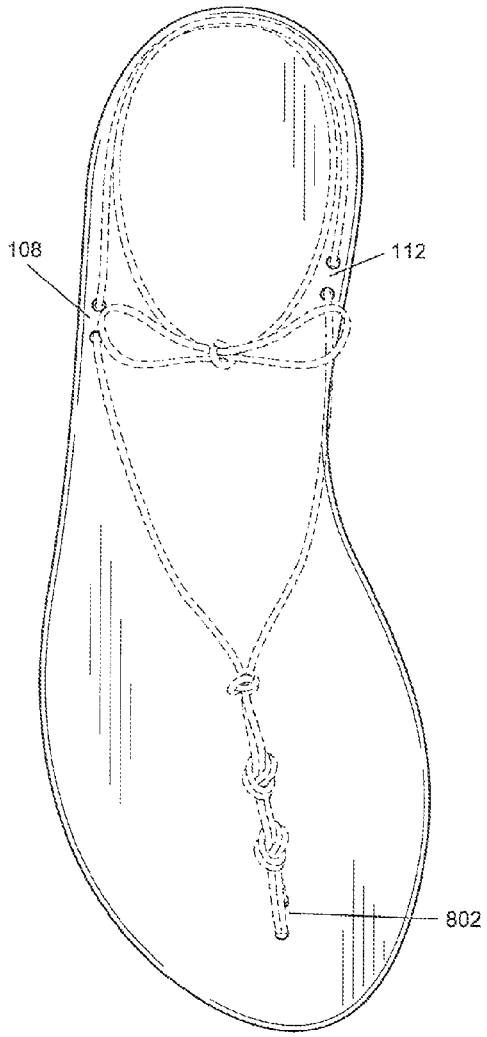
Figure 21:
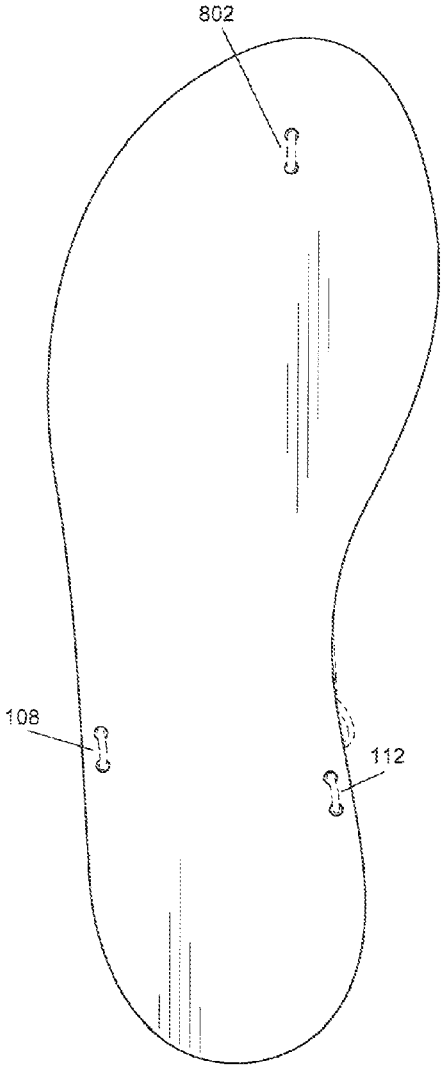
Figure 22:
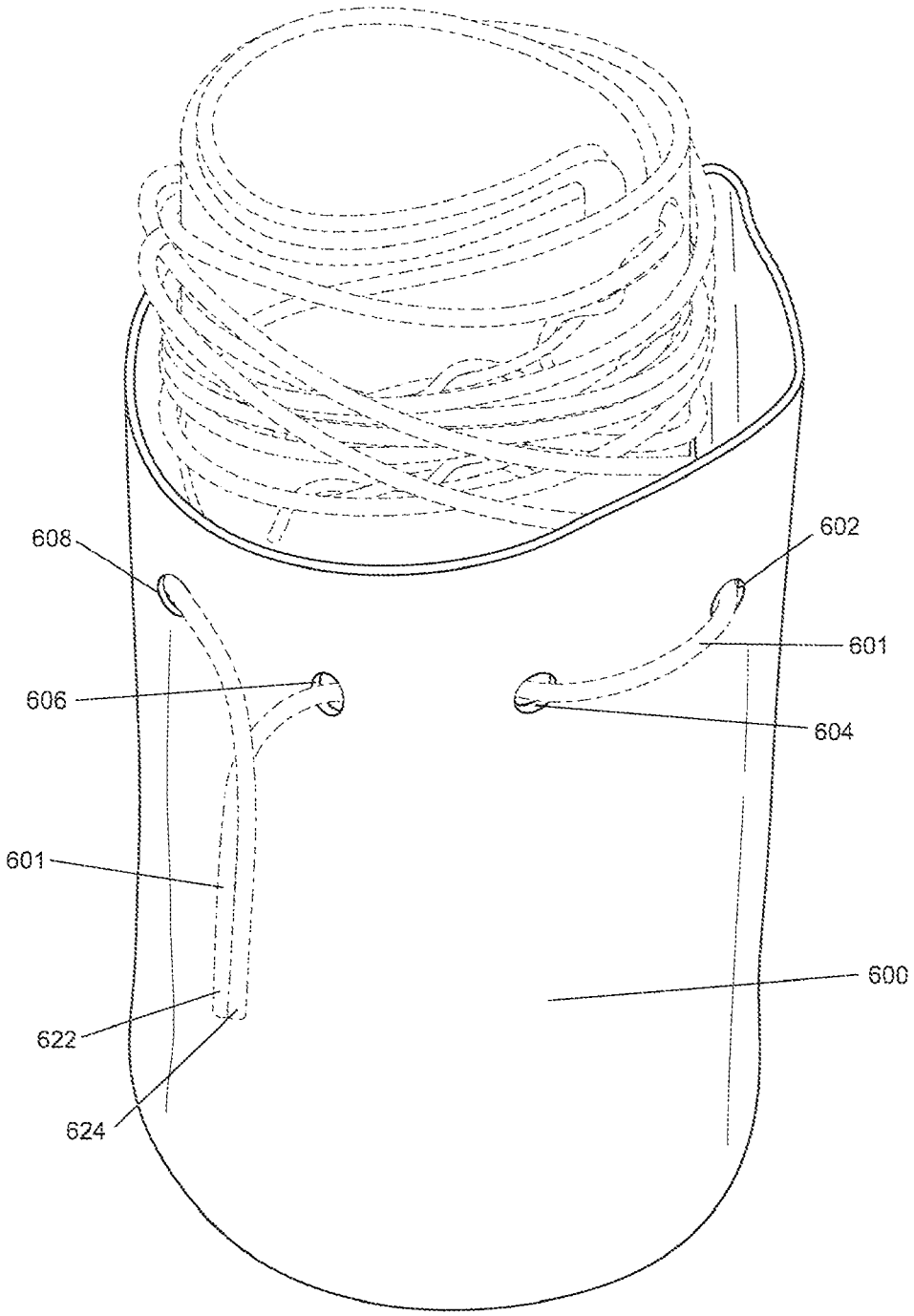
FIGS. 22-28 illustrate various views of a shoe container, according to one embodiment.
Figure 23:
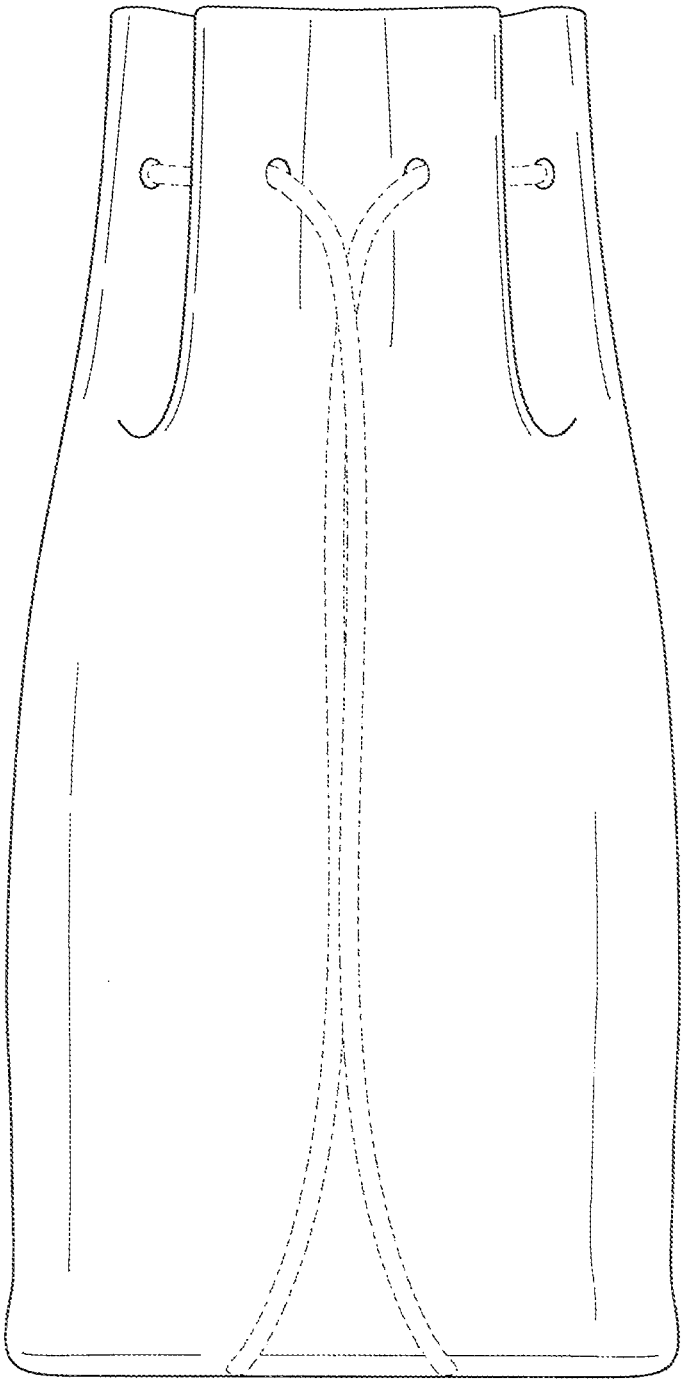
Figure 24:
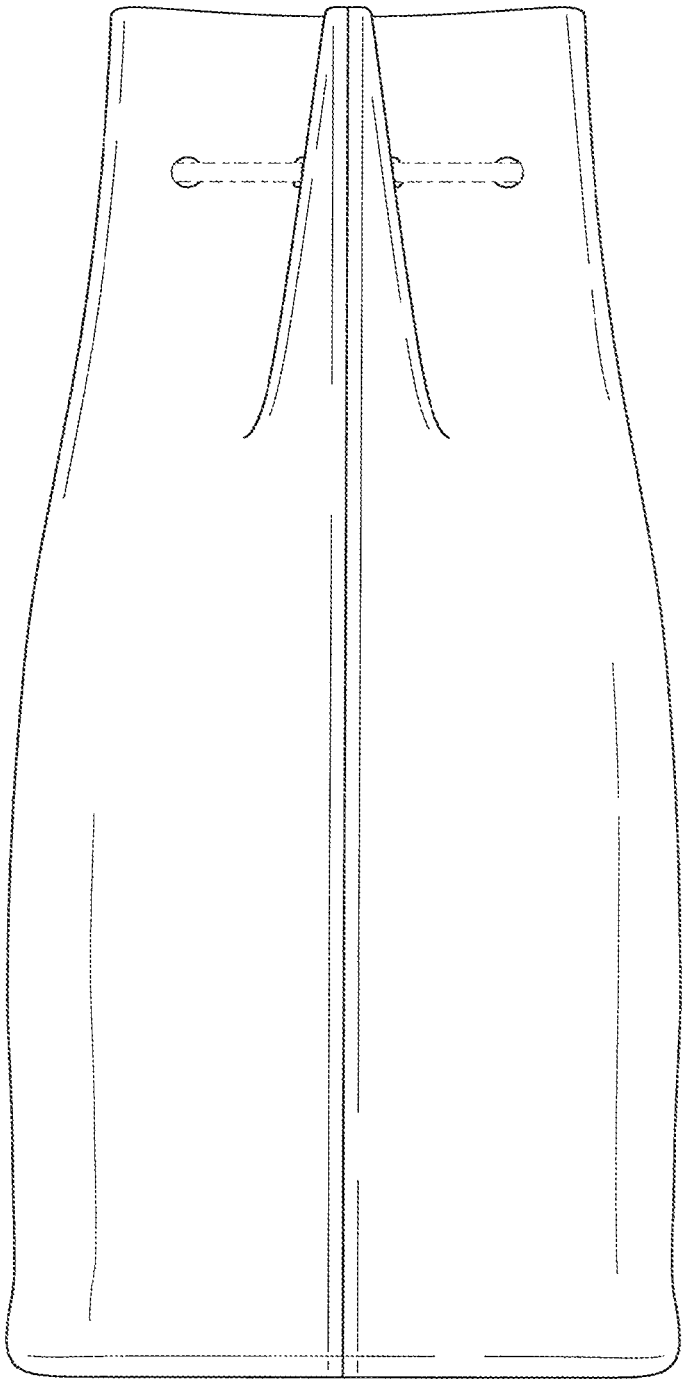
Figure 25:
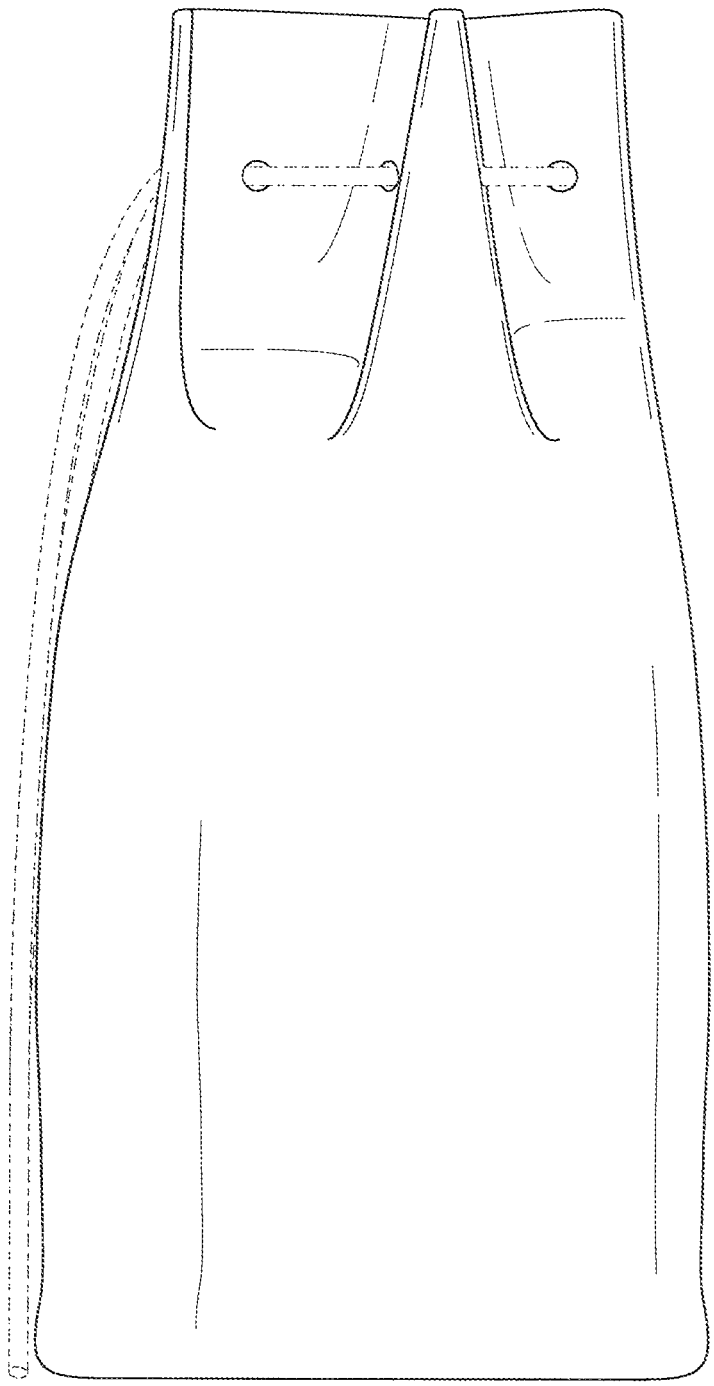
Figure 26:
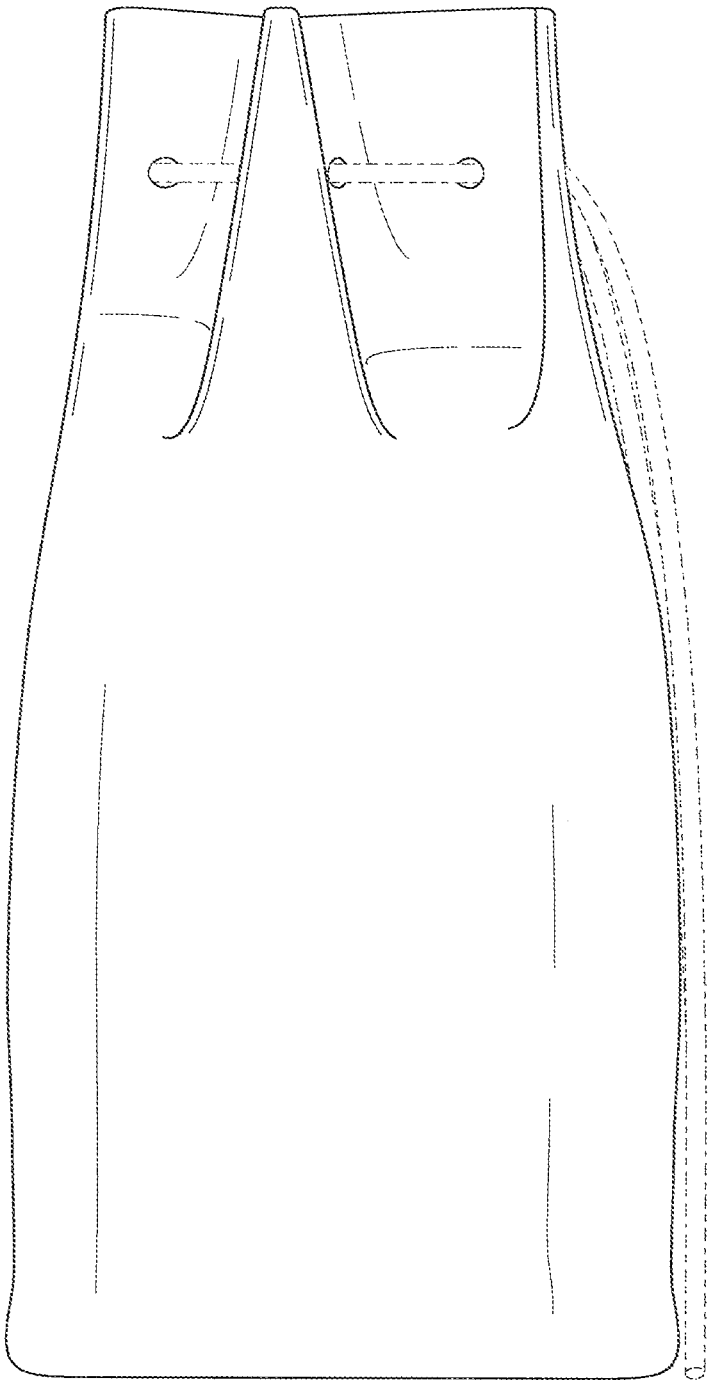

Sets of holes 106, 108, 110, and 112 are defined through the sole member 114. A strap or strap member 120 is shown cooperating with the sole member 114, and can be used to secure the user's foot. (Note that multiple straps or strap members could also be used in one embodiment.) The strap member 120 may be said to have a pair of opposed ends 122 and 124. As illustrated, when the sole member 114 and strap member 120 are assembled, the midportion of the strap member 120 is received in the holes and the opposed ends 122 and 124 of the at least one strap member 120 can be joined. In the illustrated embodiment, the ends 122 and 124 of the strap member 120 can be joined by a knot or bow-tie. With the ends 122 and 124 joined, the midportion of strap member 120 can form a loop or loops that extend from the sole member 114 for securing the user's foot and, in some embodiments, the ankle. Note that, in some embodiments, a great many ways of tying the strap member 120 can be utilized by the user so that the user can make many types of shoe designs using just the sole member 114 and the strap member 120. A few examples of how a user may tie the strap member 120 are illustrated in FIG. 1 and FIG. 15. Those of ordinary skill in the art will see that there are many other ways of tying the strap member 120.

Figure 2:
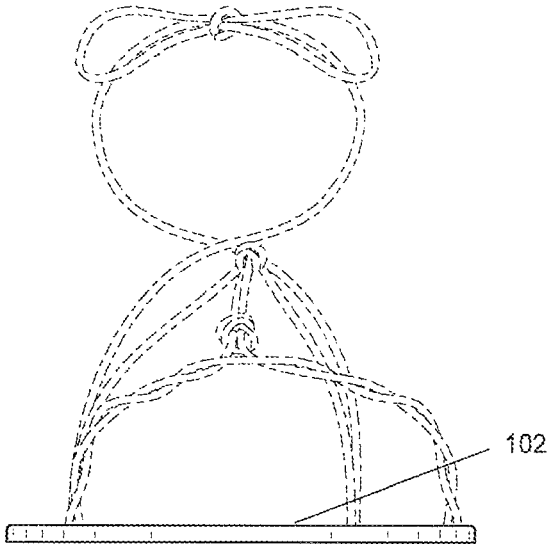
Figure 3:
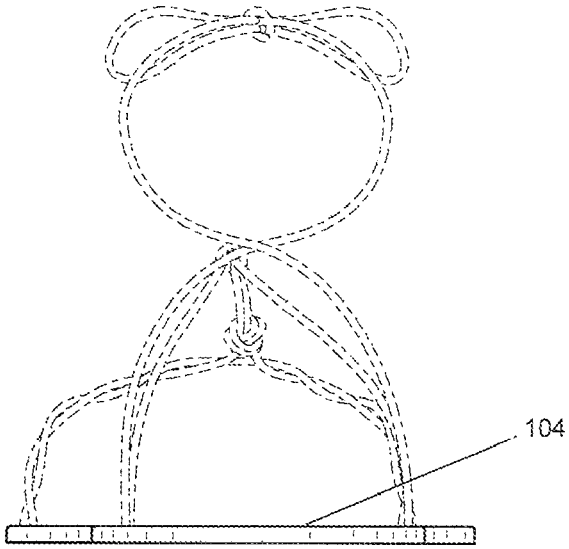
Figure 4:
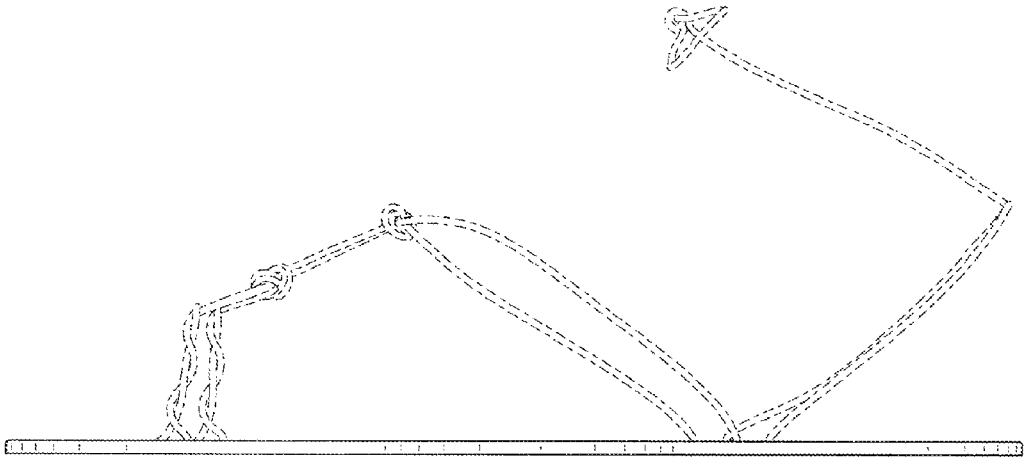
Figure 5:
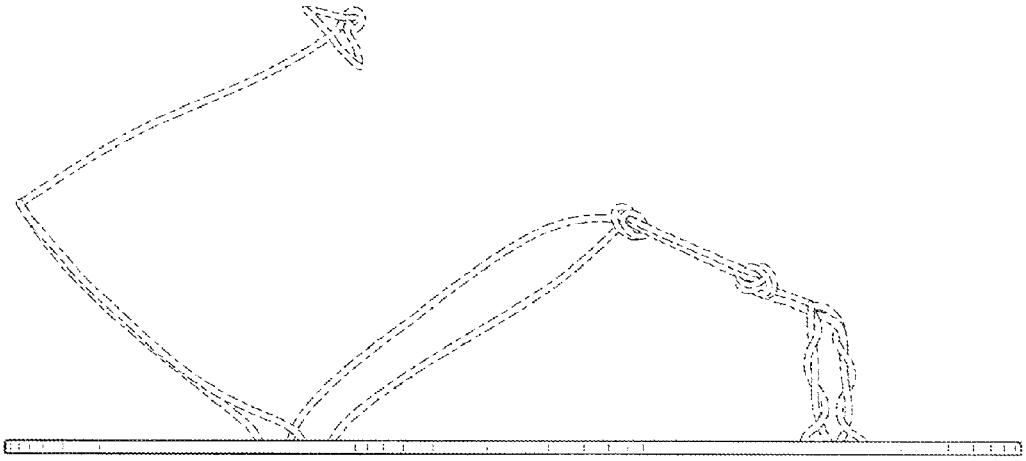
Figure 6:
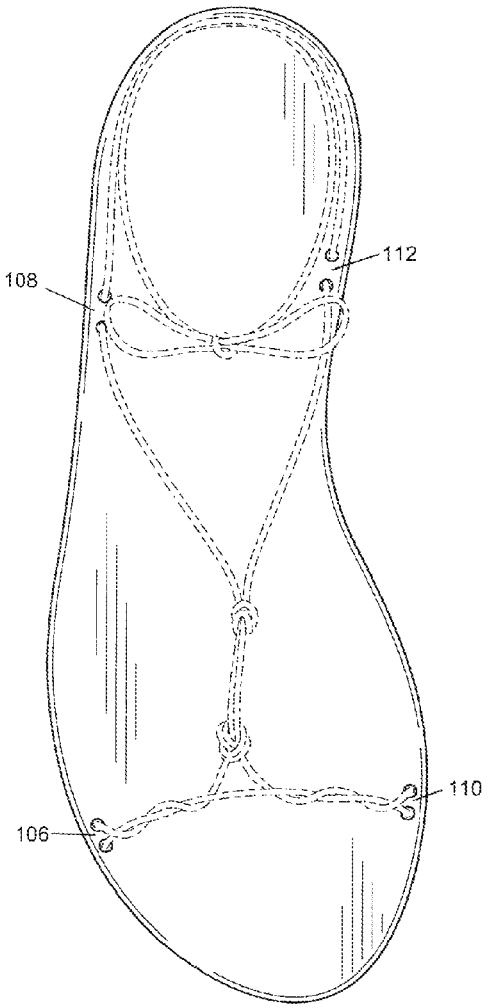
Figure 7:
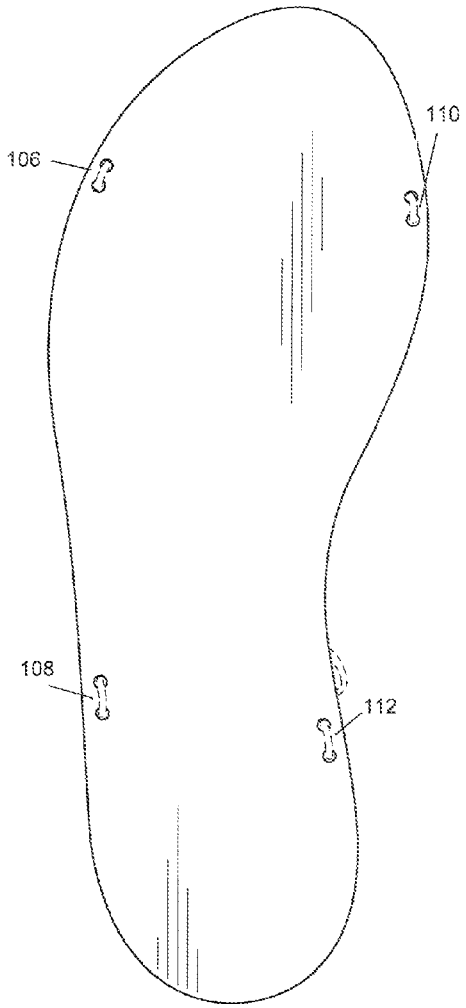
Figure 8:
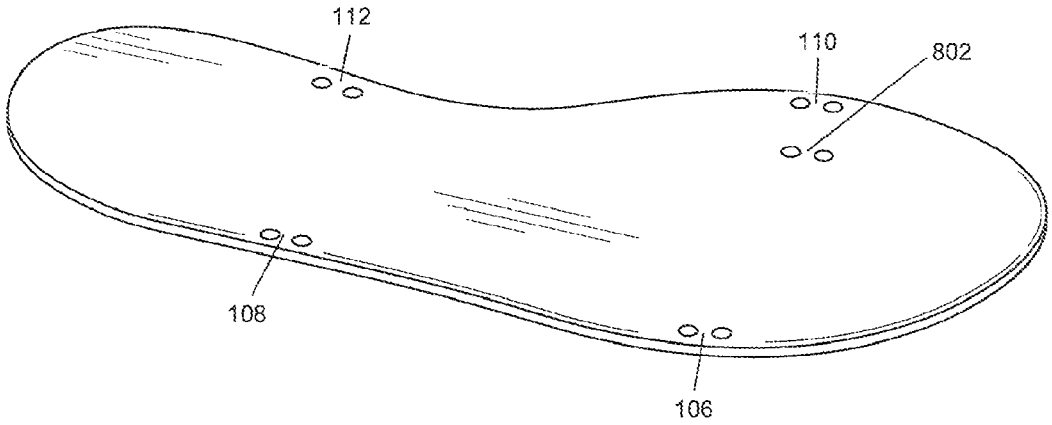
FIGS. 8-14 illustrate various views of a shoe with five sets of holes, according to one embodiment.
Figure 9:
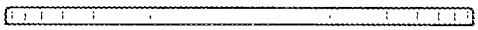
Figure 10:
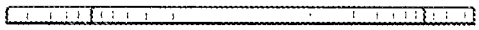
Figure 11:
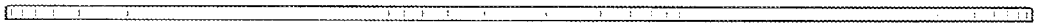
Figure 12:
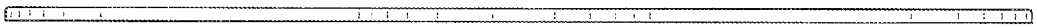
Figure 13:
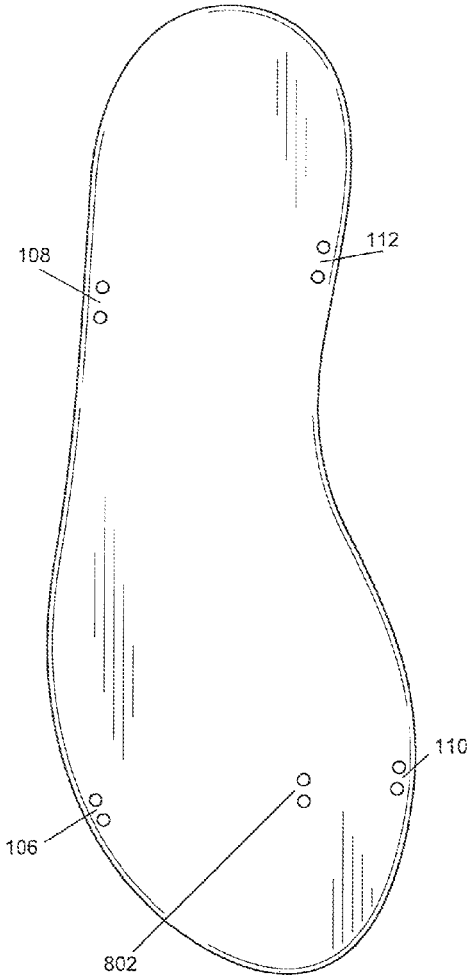
Figure 14:
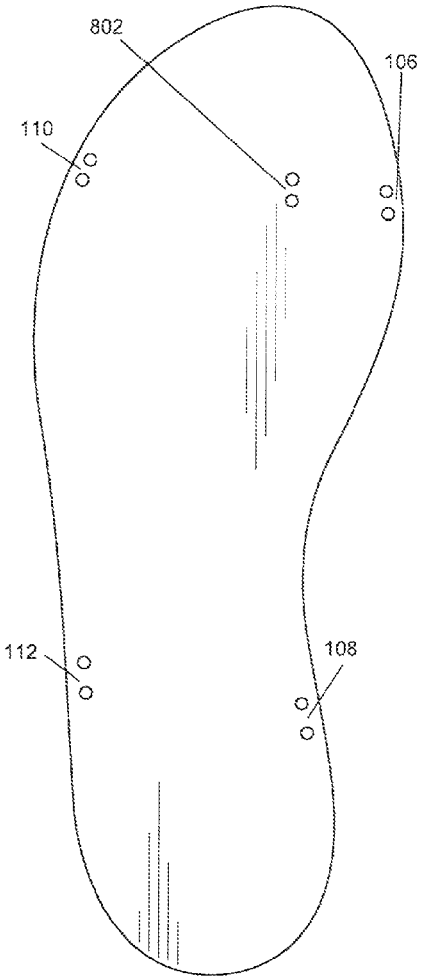

FIGS. 2 and 3 show the shoe with four sets of holes 100 from a front and rear view, respectively. FIGS. 4 and 5 are side views of the shoe with four sets of holes 100. FIGS. 6 and 7 illustrate the shoe with four sets of holes 100 from a top and bottom view.

The embodiment illustrated in FIGS. 1-7 represents one possible configuration for the shoe. Numerous alternative versions of the shoe can also be utilized. Herein below, specific embodiments will be discussed in some detail. However, some or all of these details may apply only to the illustrated embodiments and be less applicable to other variations. It should be noted that throughout this application shoe soles and straps have been illustrated only for one shoe out of a pair. As will be clear to those of ordinary skill in the art, shoes are provided in pairs, including a right shoe and a left shoe, which are essentially mirror images of one another. By illustrating only a right or a left shoe, shoe sole, or strap, the construction and use of a right and a left shoe are enabled.

According to one embodiment, a variety of styles of shoe soles may be provided, along with straps or secure means having a variety of appearances (e.g., made of different materials and/or different colors). The various shoe sole designs may receive different strap designs or secure means so as to alter their appearance and/or fit. Likewise, some strap designs may be used with more than one shoe sole design. This interchangeability of straps and/or soles allows great flexibility in the use of the present invention. Materials which can be used for the strap member 120 can include any type of elastic plastic, rubber, leather, synthetic leather, fabric, thermoplastic urethane, or EVA or any combination thereof. Those of ordinary skill in the art will see that any type of material that can be used for the sole member 114 can be used for the strap member 120. The sole member 114 and the strap member 120 can be made of the same material or different materials. In one embodiment, the sole member 114 and/or strap member 120 can include reinforcement material, which can be woven in some embodiments.

The shoe sole member 114 has a top surface 116 and a bottom surface 118, as well as an upper surface 102 and a lower surface 104. The upper and lower surfaces 102 and 104 may vary in thickness so that one surface is higher from the ground than the other surface. In addition, variations in thicknesses and padding along the sole member 114 may be used to provide a more comfortable fit for a user's foot. The shoe soles illustrated throughout are generally representative of a medium width shoe sole, however the widths and lengths may vary depending on the style and function of the shoe.

In some embodiments, the length of the shoe can increase approximately ⅓ of an inch with each whole size. Additionally, the width of the shoe can increase approximately 1/12 of an inch with each whole size. In shoes that are offered in various widths, the width of the shoe can change approximately 1/16 of an inch between width sizes. Note that, in some embodiments, different measurements can be used to increase or decrease the shoe size.

In some embodiments, the hole size is the same for all holes and all shoe sizes. This allows the use of straps with the same front-to-back width to be used with more than one size of shoe. As an alternative approach, the hole size may vary with shoe size either continuously, or in discreet steps. As one example, three different hole sizes may be used for shoes in the adult range. The holes in a set may be separated by various distances, depending on the design and style of the shoe. Also, the shape of the holes may vary to accommodate different embodiments of the invention. For instance, the hole may be oval, round, rectangular, diamond-shaped, among others. The hole may be tapered upwardly from the bottom of the sole to more closely conform the strap to the foot. That is, the hole may curve upwardly or taper upwardly so as to bring the hole entrance or exit nearer to the upper or lower surface.

When in use, the strap member 120 can exert pressure on the shoe sole member 114. One embodiment of the invention may provide reinforcement material in the shoe sole member 114, such as in immediate areas surrounding the holes. The shoe sole could also be made out of a material that is tougher and which therefore does not require reinforcement.

Referring to FIG. 6-7, an embodiment with four sets of holes 106, 108, 110, 112 therethrough on the sole member 114 is shown. Each set of holes can consist of 2 holes each. Two sets of holes 108, 112 can be positioned on the lower part of the sole member 114. In one embodiment, set 108 can be on the lower right surface and set 112 can be on the lower left surface (when looking at the top of the shoe as if a user were about to insert a foot). The two sets of holes 108 and 112 can be aligned or somewhat aligned, although other positions are also possible. Two sets of holes 106 and 110 can be positioned on the upper part of the sole member 114. Set 106 can be on the upper right surface and set 110 can be on the upper left surface. The two sets 106 and 110 can be aligned or somewhat aligned. The strap member 120 may be received and retained through the various holes to secure the foot to the sole member 114. The strap member 120 can pass from one side of the sole member 114 through one hole, and return to the same side of the sole member 114, through the nearest adjacent hole. A number of strap configurations may be used to secure the foot. In another embodiment, the holes may be used with securing means other than the strap member 120. Furthermore, a set of holes may include a single hole or three or more holes. In addition, if the set of holes include two sets of holes, as described herein, the two sets of holes can be positioned by each other in numerous configurations. For example, the FIGS. illustrate a set of holes being two holes, one on top of the other (when looking at the shoe as a user looks at the shoe when inserting a foot). However, the holes can be positioned next to each other in some or all of the sets of holes.

Referring to FIGS. 8-14, an embodiment with five sets of holes 106, 108, 110, 112, and 802 is shown. (Note that the shoe elements described in FIG. 1 can also apply to the embodiment shown in FIGS. 8-14.) Sets of holes 106, 108, 110 and 112 can be situated as described above. Set of holes 802 can be positioned on the upper region of the upper surface in a central location of the upper region. For instance, the position may be along the line of toe flexion and more particularly, between two of the toes (e.g., the big toe and the 2nd toe). This can allow the strap member 120 to better secure the foot to the sole member 360. This embodiment can also allow a user to use 2 sets of holes, 3 sets of holes, 4 sets of holes or 5 sets of holes, depending on how the user wants to tie the strap member 120 or otherwise use the sole member 114. FIGS. 8-14 thus illustrate a shoe, which may comprise: a sole member having a top surface configured to receive a user's foot and a bottom surface configured to contact a support surface. The sole member may have ten holes defined therethrough, the ten holes extending from the upper surface to the lower surface such that two holes placed next to each other may be on the upper right side of the sole member, two holes placed next to each other may be on the lower right side of the sole member, two holes placed next to each other may be on the upper left side of the sole member, two holes placed next to each other may be on the lower left side of the sole member, and two holes placed next to each other may be on the central region (e.g., an upper central region) of the sole member. A strap having opposed ends and a midportion extending therebetween may be configured to be received in and retained by any or all of the holes. The shoe may be configured so that when the strap is received in any or all of the holes and the opposed ends of the strap are joined, the strap and the sole member cooperate to secure the user's foot.

Referring to FIGS. 15-21, an embodiment with three sets of holes 108, 112, and 802 is shown. The sets of holes can be positioned as described above. (Note that the shoe elements described in. FIG. 1 can also apply to the embodiment shown in FIGS. 15-21.)

In one embodiment, the shoe may completely or partly comprise elastic sections to allow the shoe to fold or bend together. By "elastic," it is meant that the elastic section is resilient such that it returns generally to the same size as before it was bent or folded.

Figure 27:
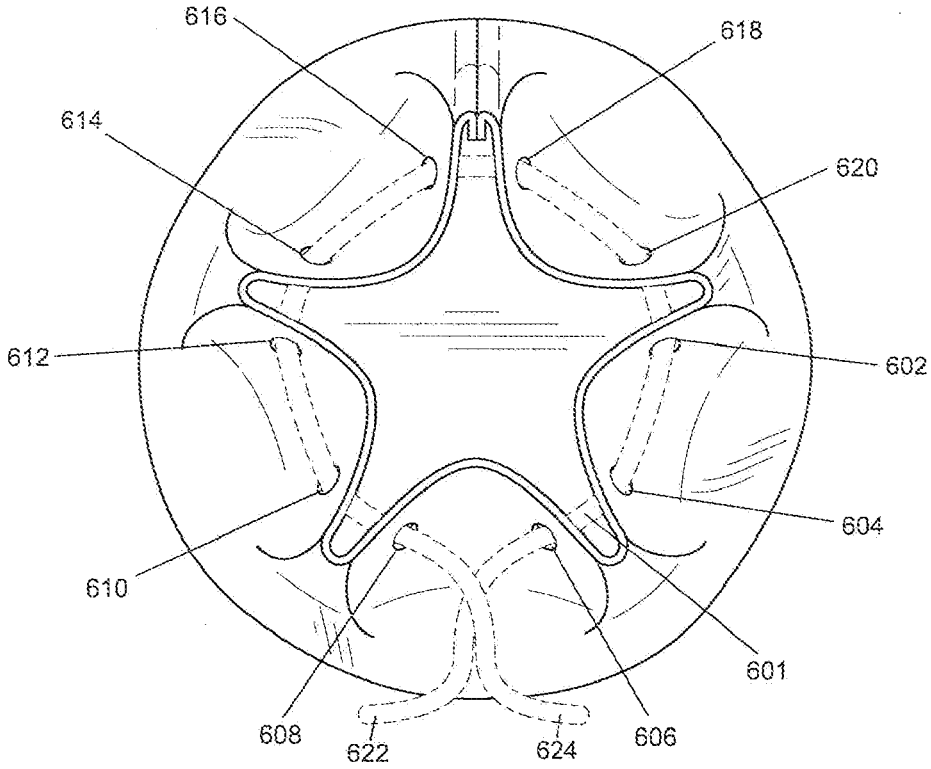
Figure 28:
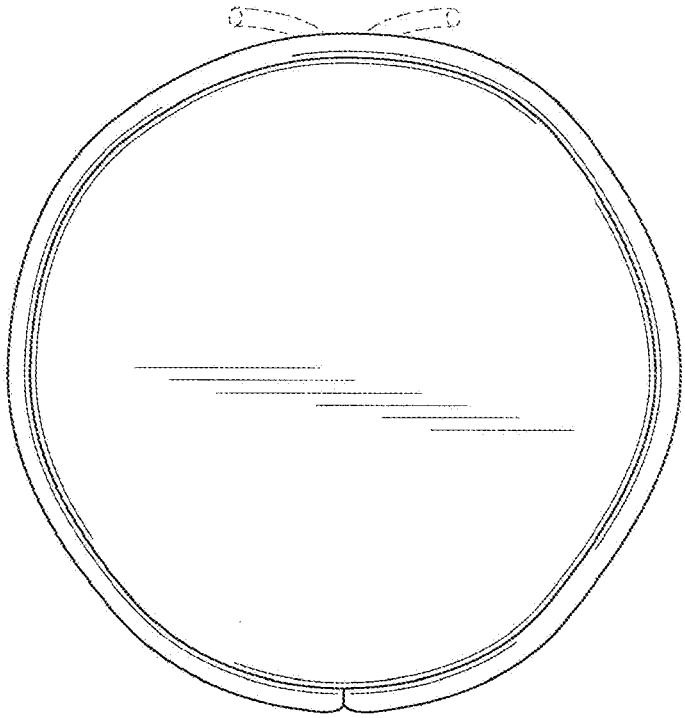

As illustrated in FIGS. 22-28, a container 600 is provided in the present invention such that the folded shoe or set of shoes fits inside the container 600. The container 600 may be entirely or partly made of fabric, leather, plastic, thermoplastic urethane, or EVA, or any combination thereof. Other materials may also be used. Additionally, the container 600 comprises a plurality of holes around the top edge of the container 600. As shown in FIG. 27, holes 602, 604, 606, 608, 610, 612, 614, 616, 618, and 620 can be spaced evenly apart from each other and be positioned parallel to the top edge of the container. In the embodiment disclosed in FIG. 27, 10 holes are utilized, but those of ordinary skill in the art will see that any number of holes can be utilized. After the folded shoe or both shoes are placed within the cavity of the container 600, strap member 601 can be passed in and out through the holes until the strap member 601 is completely wrapped around the container 600 and opposed ends 622 and 6244 have come through the nearest adjacent holes 608 and 606 as illustrated. In this way, the edge of the container may be tightened or loosened for storage of the shoes. In one embodiment, strap member 120 can be wrapped around the shoes and placed in the container 600 (or otherwise stored in the container), while strap member 601 can be used to tie the container 600. In addition, strap member 120 can be stored out of the container 600. Furthermore, in some embodiments, strap member 120 can be the same as strap member 601 and can be interchangeable such that the strap member 120 used to tie the shoe is the same strap member 610 used to tie the container. The strap member 120 used for the shoe and the strap member 601 used for the container can be made of the same or different material, including the materials listed above that can be used for the strap member 120.

While various embodiments have been described above, it should be understood that they have been presented by way of example, and not limitation. It will be apparent to persons skilled in the relevant art(s) that various changes in form and detail can be made therein Without departing from the spirit and scope. In fact, after reading the above description, it will be apparent to one skilled in the relevant art(s) how to implement alternative embodiments. Thus, the present embodiments should not be limited by any of the above-described embodiments.

In addition, it should be understood that any figures which highlight the functionality and advantages, are presented for example purposes only. The disclosed methodology and system are each sufficiently flexible and configurable, such that it may be utilized in ways other than that shown.

Further, the purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

Finally, it is the applicant's intent that only claims that include the express language "means for" or "step for" be interpreted under 35 U.S.C. 112, paragraph 6. Claims that do not expressly include the phrase "means for" or "step for" are not to be interpreted under 35 U.S.C. 112, paragraph 6.

The invention claimed is:

1. A shoe, comprising:

at least one sole member having an outer perimeter region and an inner central region at least one top surface configured to receive a user's foot and at least one bottom surface configured to contact at least one support surface;

the at least one sole member having only ten holes defined therethrough, the ten holes extending from the at least one upper surface to the at least one lower surface wherein two holes placed next to each other are on an upper right side of the at least one sole member at the outer perimeter, two holes placed next to each other are on a lower right side of the at least one sole member at the outer perimeter, two holes places next to each other are on an upper left side of the at least one sole member at the outer perimeter, two holes placed next to each other are on a lower left side of the at least one sole member at the outer perimeter, and two holes placed next to each other are on the central region of the at least one sole member; and at least one strap having at least one pair of opposed ends and at least one midportion extending therebetween, the at least one strap being configured to be received in and retained by any or all of the holes;

the shoe being configured so that when the at least one strap is received in any or all of the holes and the at least one pair of opposed ends of the at least one strap are joined, the at least one strap and the at least one sole member cooperate to secure the user's foot.

2. The shoe of claim 1, wherein the at least one strap can be laced in any of the holes and tied in a variety of ways.

3. The shoe of claim 1, wherein the shoe is flexible so that the shoe can be folded up and stored in a container.

4. The shoe of claim 3, wherein the container is a bag.

5. The shoe of claim 1, wherein the two holes placed next to each other on the central region of the at least one sole member are on the upper central region of the at least one sole member.

6. The shoe of claim 5, wherein the at least one strap can be laced in any of the holes and tied in a variety of ways.

7. The shoe of claim 5, wherein the shoe is flexible so that the shoe can be folded up and stored in a container.

8. The shoe of claim 7, wherein the container is a bag.

* * * * *